US008069873B2

(12) United States Patent
Belaire

(10) Patent No.: US 8,069,873 B2
(45) Date of Patent: Dec. 6, 2011

(54) METHOD AND APPARATUS FOR REMOVING LIQUIDS FROM RISERS

(76) Inventor: Dwayne J. Belaire, Carencro, LA (US)

( * ) Notice: Subject to any disclaimer, the term of this patent is extended or adjusted under 35 U.S.C. 154(b) by 400 days.

(21) Appl. No.: 12/386,383

(22) Filed: Apr. 17, 2009

(65) Prior Publication Data

US 2009/0260694 A1 Oct. 22, 2009

Related U.S. Application Data

(60) Provisional application No. 61/124,729, filed on Apr. 18, 2008.

(51) Int. Cl.
*F16T 1/34* (2006.01)

(52) U.S. Cl. ..... 137/1; 137/171; 137/205.5

(58) Field of Classification Search ..... 137/205.5, 137/171, 1

See application file for complete search history.

(56) References Cited

U.S. PATENT DOCUMENTS 3,304,564 A * 2/1967 Green et al. ..... 137/205.5
3,776,274 A * 12/1973 Riley ..... 137/205.5
3,943,958 A * 3/1976 Davis, Jr. ..... 137/217

* cited by examiner

*Primary Examiner* — Kevin Lee
(74) *Attorney, Agent, or Firm* — Ted M. Anthony

(57) ABSTRACT

A bypass assembly is provided for preventing unwanted liquids from collecting within fuel gas risers, exiting such risers and contaminating fuel gas systems. A conduit extends from a riser vessel to a natural gas flow line. An insert extends from the bypass line into the natural gas flow line. As production flows through the flow line and insert, a suction force is created that draws liquids from the riser into the conduit and, ultimately, back into the flow line system.

6 Claims, 3 Drawing Sheets

METHOD AND APPARATUS FOR REMOVING LIQUIDS FROM RISERS

CROSS REFERENCES TO RELATED APPLICATIONS

This Application claims the benefit of, and priority from, U.S. Provisional Patent Application Ser. No. 61/124,729 filed Apr. 18, 2008 which is incorporated by reference.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention relates to a method and apparatus for removing unwanted liquids from vessels used to collect fuel gas. More particularly, the present invention relates to a method and apparatus for removing liquids from fuel gas risers used in connection with oil and/or gas wells and related facilities. More particularly still, the present invention relates to a method and apparatus for preventing liquids from flowing out of fuel gas risers used to provide fuel gas to production platforms and/or similar facilities.

2. Brief Description of the Prior Art

Oil and gas production installations in general, and offshore platforms and other similar structures in particular, typically include various automated facilities and other equipment requiring fuel to operate. Such facilities and equipment include, but are not limited to, production processing equipment, control panels, automatic valves and/or other facilities.

Frequently, natural gas produced from one or more wells supported by a platform or other structure can be used as fuel to power equipment situated on or otherwise associated with such platform or other structure. In such cases, a relatively small volume of natural gas—commonly referred to as "fuel gas"—is typically diverted to such equipment from production flow line(s) used to transport such production from the platform or other facility to a sales or custody-transfer point (such as, for example, a gas sales meter).

In such cases, at least one fuel gas riser is typically connected to a natural gas flow line at a location upstream of the gas sales meter. Although such fuel gas risers can have any number of different shapes, sizes and configurations, such risers are typically substantially hollow, upright vessels that are connected to a gas flow line. An opening at or near the base of a riser extends into the flow line, and permits communication between the inside of the flow line and the inner chamber of the substantially hollow riser.

As natural gas flows through the flow line, a relatively small volume of such gas is diverted from the flow line and into the inner chamber of the substantially hollow fuel gas riser. An outlet extends from said riser near the upper end of said riser. Natural gas ascends within the riser vessel, and exits said riser via said outlet. Natural gas exiting the vessel via the outlet is ultimately piped to equipment that is powered using such fuel gas. In many cases, such fuel gas is first piped to a control panel, and is thereafter distributed to other downstream equipment where it is ultimately consumed.

Frequently, natural gas production contained within flow lines contains associated liquid components including, but not necessarily limited to, oil, water and/or condensate. In certain situations, such liquid components can collect within such fuel gas risers along with the natural gas. If liquid components inside a fuel gas riser reach the fuel gas outlet of such riser, the liquid components can exit the riser vessel via the fuel gas outlet.

In most cases, equipment and piping designed to receive fuel gas from a fuel gas riser are specifically designed to handle, process and/or consume only fuel existing in a gaseous state. As a result, such equipment and piping are generally incapable of handling, processing and consuming fuel in a liquid state. In such cases, unwanted liquid(s) exiting the fuel gas riser can render such downstream equipment inoperable. Frequently, unwanted liquids exiting a fuel gas riser can trigger automatic valves that, in turn, can cause wells to be shut-in and production to be interrupted. Moreover, such liquid production can spill out of such equipment (including, without limitation, the control panel), and into the surrounding environment, thereby resulting in contamination of such environment. In marine environments in particular, such spillage can create oil slicks that are difficult to contain and can cover very large areas.

In many cases, fuel gas risers are installed on unmanned platforms and other structures. Escape of liquids from such risers is particularly problematic on such unmanned platforms and other structures because personnel are usually not present to take immediate corrective action. Typically, personnel must be dispatched from one or more distant locations to remove unwanted liquids from the riser, clean all contaminated equipment, restore the wells and associated equipment to production and remediate any pollution of the surrounding environment.

Unwanted escape of liquids from fuel gas risers can have significant adverse consequences for owners and/or operators of platforms or other structures equipped with such risers. When wells are unexpectedly shut in, revenues generated from the sale of production from such wells are interrupted; in some cases, such interruptions can be for extended periods of time (especially in the case of unmanned platforms or structures). Further, it is often costly to dispatch personnel and equipment from distant locations in order to address such problems. Environmental remediation of pollution in particular can be extremely expensive. In some cases, such pollution can also result in fines or penalties from governmental bodies and/or regulatory agencies.

Thus, there is a need for an inexpensive, efficient and effective means for preventing unwanted liquids from collecting in fuel gas risers and escaping from such risers into associated equipment and/or the surrounding environment. Said means should be capable of beneficially functioning on unmanned platforms and similar structures. Further, such means should prevent unexpected shutting-in of producing oil and/or gas wells, as well as unwanted pollution associated with discharge of such liquids into the environment.

SUMMARY OF THE PRESENT INVENTION

The present invention comprises a bypass assembly that facilitates removal of unwanted liquids from fuel gas risers, thereby preventing such liquids from escaping into downstream equipment and/or the surrounding environment. In the preferred embodiment, the bypass assembly of the present invention comprises a tube or conduit having first and second ends. The first end of said conduit connects to a fuel gas riser at a desired vertical elevation on said riser, while the second (opposite) end of said conduit connects to a production flow line at a desired location downstream from said riser. A suction force is beneficially created within said bypass assembly to draw liquids away from said riser, and transfer said liquids back into said flow line for subsequent removal/disposition with other production passing through such flow line.

In the preferred embodiment, the bypass assembly of the present invention further comprises an insert member that extends into said flow line near the second end of said bypass conduit. As fluid within said flow line move past said insert member, a suction force is created. Liquids present in the fuel gas riser are drawn into the bypass assembly by such suction force. Such liquids ultimately pass through said bypass assembly and into the downstream portion of the production flow line for subsequent disposition or sale.

The bypass assembly of the present invention significantly enhances the performance of conventional fuel gas riser systems by maintaining a desired liquid level within in a fuel gas riser vessel. Because such liquids do not collect above the level of the riser/bypass assembly interface, the bypass assembly of the present invention eliminates the problems associated with liquids escaping out of the fuel gas outlet at or near the top of the fuel gas riser.

In the preferred embodiment, the bypass assembly of the present invention also includes a choke. Although a positive choke can be used for this purpose, an adjustable choke is used in the preferred embodiment because such choke size can be changed with minimal effort. Such choke permits application of a desired back-pressure on said bypass assembly which, in turn, permits additional control of the liquid level in the fuel gas riser.

Said bypass assembly may also include at least one valve to block flow through said bypass assembly. Although said at least one valve can be used for any number of different functions, it is to be observed that said at least one valve can be used to interrupt flow through the bypass assembly to accommodate maintenance or repair of the various components of said bypass assembly.

The bypass assembly of the present invention can be installed in connection with new or existing fuel gas risers. If the bypass assembly is added to an existing fuel gas riser system, a bypass insert housing may be included for incorporation within a flow line downstream of said riser. Is to be understood that the bypass assembly of the present invention may alternatively connect directly to a portion of the flow line (that is, without use of a bypass assembly housing). Alternatively, it is also to be understood that the present invention can be manufactured as a single modular unit (that is, riser, bypass assembly, and insert) that can be installed essentially as a single component within a flow line.

In the preferred embodiment, the primary axis of the bypass insert member forms an acute angle with the longitudinal axis of the natural gas flow line in the direction of such flow. In one embodiment, said bypass insert member includes at least one aperture on its downstream side and at least one aperture on its upstream side. In a preferred embodiment, said at least one upstream aperture is positioned so that a portion of said upstream aperture is horizontally and vertically aligned with said at least one downstream aperture of the bypass insert. In this manner, production flowing through the flow line can beneficially enter the bypass insert through the upstream aperture and exit said insert through the downstream aperture in a substantially unobstructed flow pattern that is generally parallel to the direction of flow in said flow line.

Thus, it is an object of the present invention to prevent unwanted liquids from collecting within fuel gas risers. It is a further object of the present invention to prevent liquids from exiting such fuel gas risers through the outlet(s) of said fuel gas risers. It is yet a further object of the present invention to prevent liquids from invading equipment downstream of the outlets of fuel gas risers, and contaminating the environment surrounding said fuel gas risers.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed.

DETAILED DESCRIPTION OF A PREFERRED EMBODIMENT OF THE INVENTION

Figure 1:
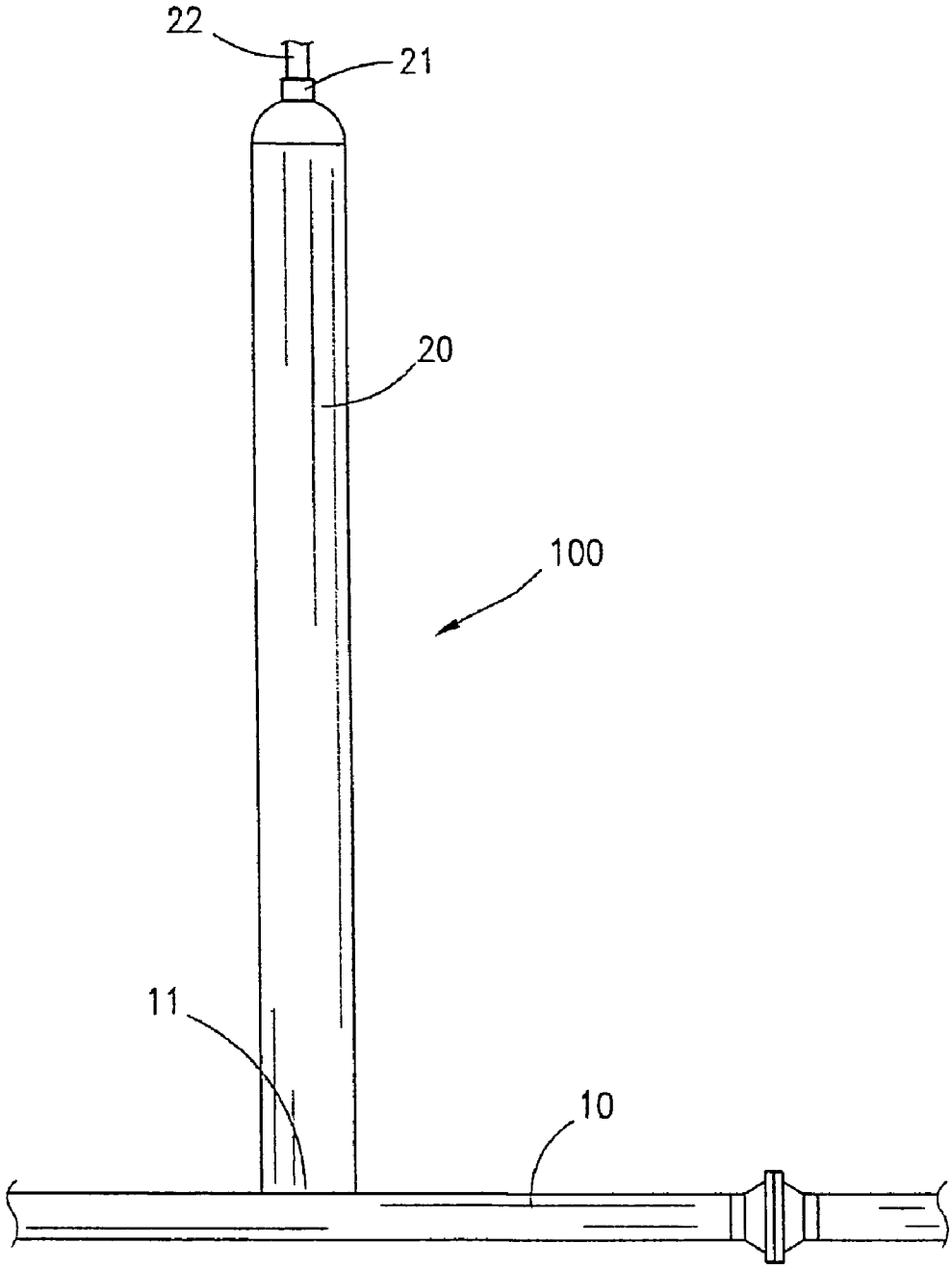
Fig. 1 PRIOR ART
FIG. 1 is a side view of a prior art fuel gas riser connected to a natural gas flow line.

FIG. 1 depicts a side view of a prior art fuel gas recovery system 100. Fuel gas riser, generally 20, comprises an upright vessel vertically attached to and in communication with an inner flow bore of natural gas flow line 10 at riser inlet 11. As depicted in FIG. 1, natural gas flowline 11 is a pipeline having an inner flow bore for transporting produced fluids. Fuel gas riser 20 generally comprises a substantially hollow vessel defining an inner chamber. Although not depicted in FIG. 1, an opening extends from said inner chamber of fuel gas riser 20 into the inner flow bore of natural gas flow line at riser inlet 11. Fuel gas outlet port 21 connects fuel gas riser 20 to fuel gas supply line 22. It is to be understood that fuel gas outlet port 21 may be located on the upper-most surface of fuel gas riser 20, as shown in FIG. 1, or on a side surface near the upper portion of fuel gas riser 20.

Natural gas production flowing through the inner flow bore of gas flow line 10 enters fuel gas riser 20 at riser inlet 11, and collects within the inner chamber of fuel gas riser 20. Such gas ascends within fuel gas riser 20, flows through fuel gas outlet port 21 and into fuel gas supply line 22. In many cases, fuel gas supply line 22 leads to a master control panel (not depicted in FIG. 1) for distribution to downstream equipment powered by such fuel gas. Gas diverted into fuel gas riser 20 and out fuel gas supply line 22 is used to power various types of equipment in the general vicinity of fuel gas riser 20.

Produced fluids flowing through natural gas flow line 10 may contain various amounts of oil, water and other liquid components. If liquid components are present in such fluids, the liquid components can collect within the inner chamber of fuel gas riser 20. As additional liquid collects inside fuel gas riser 20, the liquid level can rise within such vessel. Eventually, if enough liquids are present, the liquid level inside fuel gas riser 20 may reach fuel gas outlet port 21 and fuel gas supply line 22. Liquid components can exit riser 20 via fuel gas supply line 22, and can eventually reach the master control panel and/or other downstream equipment fueled by such fuel gas. However, such master control panel and/or other downstream equipment are typically not capable of handling liquid components in the fuel gas supply. As a result, spill and shut-in problems frequently result from the presence of such unwanted liquid components in such equipment.

Figure 2:
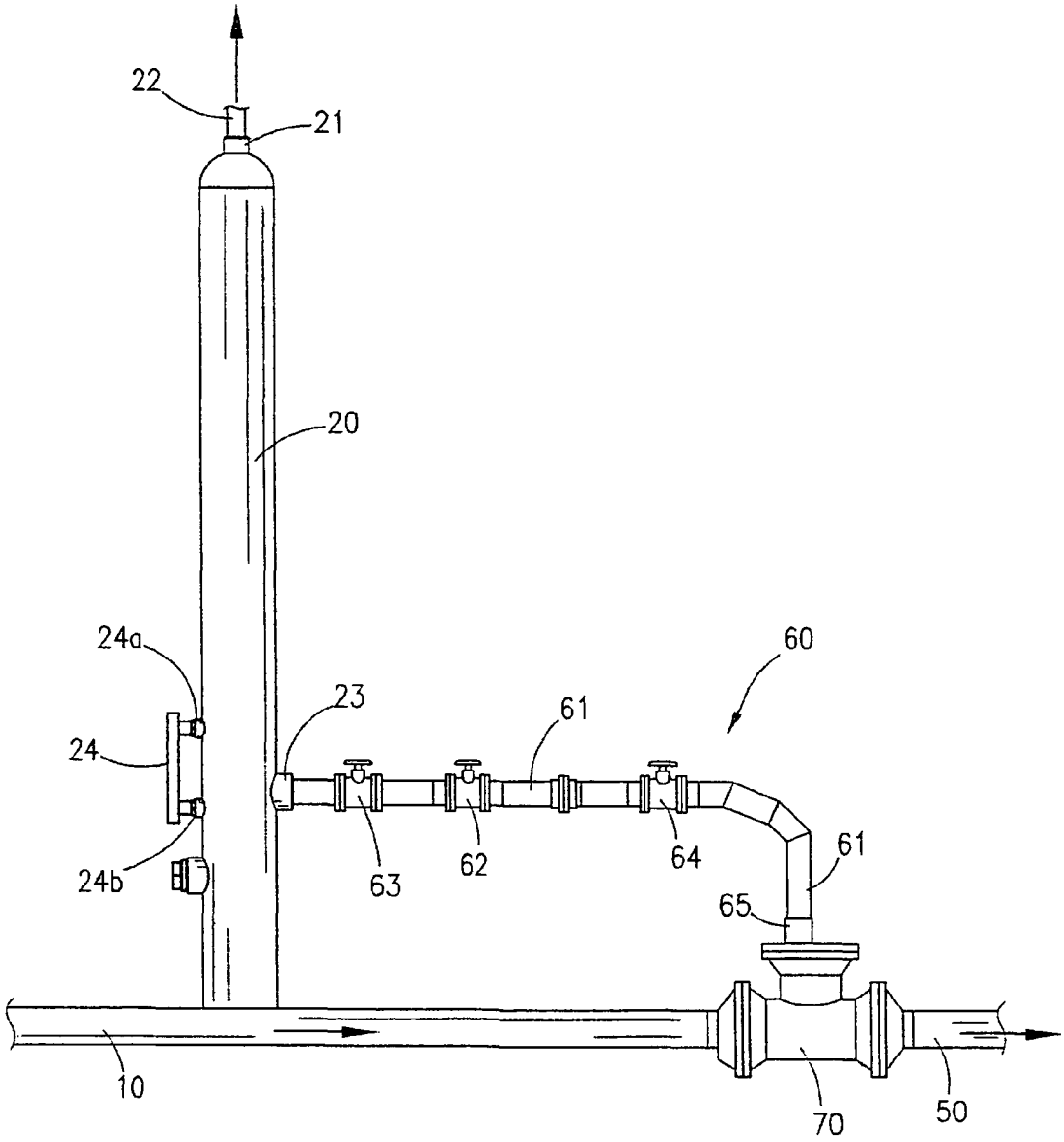
FIG. 2 is a side view of the bypass assembly of the present invention installed on a conventional fuel gas riser and natural gas flow line.

FIG. 2 depicts the bypass assembly 60 of the present invention installed on an existing fuel gas riser system, such as prior art fuel gas recovery system 100 depicted in FIG. 1. Like elements in each figure have been given like numerical designations to facilitate an understanding of the present invention. Bypass assembly 60 of the present invention comprises siphon bypass line 61. It is to be understood that siphon bypass line 61 may be comprised of one continuous section of piping, or two or more connected pipe or tubular sections. At one end, siphon bypass line 61 is connected to, and in fluid communication with, fuel gas riser 20 at liquid outlet port 23. Although a number of different connection means can be used, in the preferred embodiment bypass line 61 is connected to liquid outlet port 23 through the use of a connecting means such as a "thread-o-let" connection. At the opposite end, siphon bypass line 61 is connected to flow line 10 via bypass insert housing 70, which is described in more detail below. Downstream flow line 50 is connected to bypass insert housing 70 to transport produced fluids to a sales meter or other disposition.

In the preferred embodiment of the present invention, sight glass 24 is connected to fuel gas riser 20. Sight glass 24 generally comprises a transparent tube that permits visual determination of the liquid level within the inner of chamber of fuel gas riser 20. If a liquid/gas interface is visible within sight glass 24 between upper sight glass connection 24*a* and lower sight glass connection 24*b*, then the liquid level within the inner chamber of fuel gas riser 20 is likewise between said connections 24*a* and 24*b*. When the liquid level inside fuel gas riser 20 is below lower sight glass connection 24*b*, no liquid is visible in sight glass 24. Conversely, when the liquid level inside fuel gas riser 20 is above upper sight glass connection 24*a*, sight glass 24 appears full of liquid. In the preferred embodiment, liquid outlet port 23 is positioned vertically between upper sight glass connection 24*a* and lower sight glass connection 24*b*.

By maintaining a desired liquid level within fuel gas riser 20 and preventing unwanted liquids from exiting fuel gas riser 20 via fuel gas outlet port 21, bypass assembly 60 of the present invention ensures that only gaseous components reach a master control panel and/or other downstream equipment via fuel gas supply line 22. In this manner, the present invention prevents liquid production components from escaping riser 20 and contaminating downstream equipment and/or polluting the surrounding environment.

In a preferred embodiment, bypass assembly 60 of the present invention includes a choke, such as a positive choke or, as depicted in FIG. 2, adjustable choke 62. Choke 62 allows adjustment of the flow rate through siphon bypass line 61. In most cases, adjustable choke 62 is preferred over a positive choke. Bypass assembly 60 further comprises first valve 63, and second valve 64. When closed, valves 63 and 64 prevent the flow of fluids through bypass line 61. By way of illustration, but not limitation, valves 63 and 64 can be closed to interrupt fluid flow through bypass line 61 in order to perform maintenance or repair of adjustable choke 62.

Figure 3:
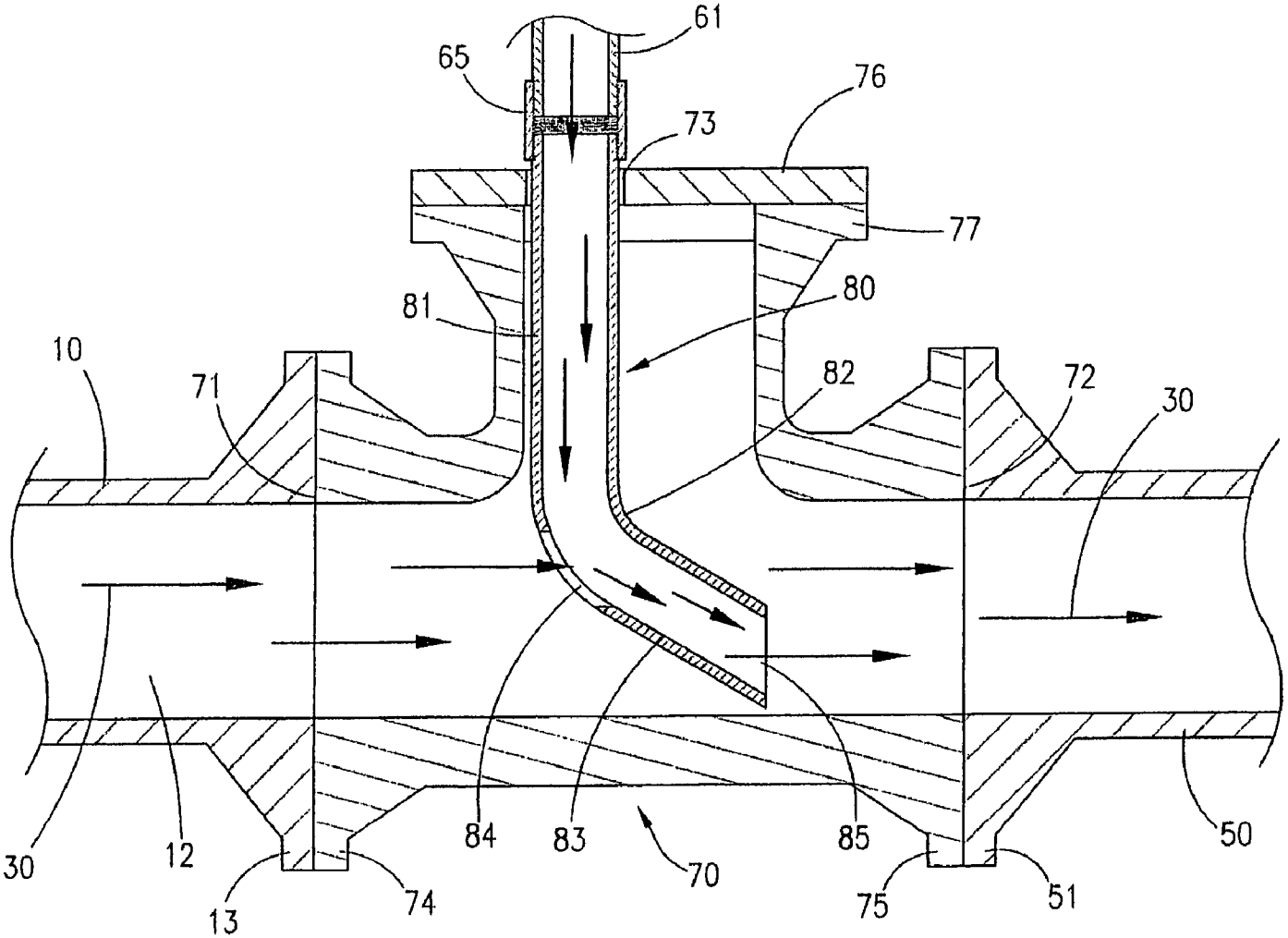
FIG. 3 is a side sectional view of a portion of the bypass assembly of the present invention.

FIG. 3 depicts a side sectional view of bypass insert housing 70 of the present invention. Referring to FIG. 3, substantially tubular insert member 80 generally forms a continuation of the conduit formed by siphon bypass line 61, and partially extends into the path of produced fluids flowing through flow line 10. In the preferred embodiment, substantially tubular bypass insert member 80 generally comprises upper extension neck section 81, curved middle section 82, and lower end section 83. A portion of siphon bypass insert 80 extends into the path of produced fluids flowing through bypass insert housing 70.

It is to be understood that many different means can be used to position siphon bypass insert 80 into the path of produced fluids flowing through flow line 10. In the preferred embodiment, siphon bypass line 61 connects to upper extension neck section 81 of bypass insert member 80 via insert connection 65, which, in the preferred embodiment, is a threaded connection. Still referring to FIG. 3, upper extension neck section 81 of bypass insert member 80 extends through bore 73 in upper plate member 76. In the preferred embodiment, upper plate member 76 is secured to an upper opening flange 77 of insert housing 70 (typically using conventional flange bolts or the like). A pressure seal is formed where upper extension neck section 81 passes through bore 73.

Insert housing 70 connects to flange 13 of flow line 10 using inlet flange 74. Similarly, insert housing 70 connects to flange 51 of pipeline 50 using outlet flange 75. Produced fluids flow in direction 30 through pipeline 10, into bypass insert housing 70 (and bypass insert member 80, which extends, at least partially, into such flow path), and then into pipeline 50.

As produced fluids flow through inner bore 12 of natural gas flow line 10 in the direction of arrows 30, said fluids enter siphon bypass insert housing 70 through inlet 71. Said fluids flow around and through siphon bypass insert 80, and exit the bypass insert housing 70 via outlet 72. Said fluids pass into pipeline 50 for transportation to sales or other disposition.

In the preferred embodiment of the present invention, upstream aperture 84 extends through one wall of insert 80 and is positioned on the upstream face of siphon bypass insert 80. Said upstream aperture 84 allows produced fluids to flow through a portion of said siphon bypass insert 80. The flow of produced fluids through upstream aperture 84, through a section of siphon bypass insert 80, and out of downstream opening 85 (which is oriented in a direction generally away from riser 20) creates a suction or siphon effect that acts to draw fluids from siphon bypass line 61.

In the preferred embodiment, upstream aperture 84 is positioned on siphon bypass insert 80 so that at least a portion of upstream aperture 84 is vertically aligned with at least a portion of downstream aperture 85. That is, a bottom edge of said upstream aperture 84 is lower than an upper edge of downstream aperture 85. Such positioning allows produced fluids to flow through upstream aperture 84 and downstream aperture 85 in substantially unobstructed flow pattern that is substantially parallel to the longitudinal axis of natural gas flow line 10 and flow direction 30.

In operation, produced fluids flow through natural gas flow line 10 in flow direction 30. Some of these produced fluids enter fuel gas riser 20 through the fuel gas riser inlet 11. The gaseous components of such fluids collect inside fuel gas riser 20, ascend to fuel gas outlet port 21, and enter the fuel gas supply line 22. Liquid components of such produced fluids collect inside fuel gas riser 20, and remain at the bottom of fuel gas riser 20, thereby forming an internal liquid level within said riser 20. The weight of the liquid column above outlet port 23, as well as the siphon force created by bypass insert member 80 of the present invention, draws such liquids through liquid outlet port 23 of riser 20 and into siphon bypass line 61. Such liquids continue to flow through siphon bypass line 61 and into siphon bypass insert 80 and mix with the produced fluids flowing through housing 70 and pipeline 50. This process effectively maintains a desirable liquid level within the fuel gas riser 20, thereby eliminating the problems associated with liquid components exiting fuel gas riser 20 via fuel gas supply line 22.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method for siphoning liquids from a fuel gas riser connected to a flow line to prevent said liquids from extending beyond a predetermined vertical level in said riser comprising:

a. connecting a conduit having a first end and a second end, wherein said first end of said conduit is attached to said riser at said predetermined vertical level, and said second end of said conduit is attached to said flow line downstream of said riser;

b. applying a suction force to said conduit; and c. transferring liquids from said riser to said flow line through said conduit.

2. The method of claim 1, wherein said step of applying suction force to said conduit further comprises extending said second end of said conduit into said flow line.

3. The method of claim 2, wherein said step of extending said second end of said conduit into said flow line further comprises connecting an insert member to said second end of said conduit, wherein at least a portion of said insert member is positioned in said flow line.

4. The method of claim 3, wherein said insert member further comprises a substantially tubular member having a first end, a second end and a curved section between said first and second ends.

5. An apparatus for removing liquids from a fuel gas riser connected to a flow line comprising:

a. a conduit having a first end and a second end, wherein said first end is connected to said riser and said second end is connected to said flow line downstream of said riser; and b. a substantially tubular insert having a first end, a second end, a curved section between said first and second ends, openings at said first and second ends and at least one aperture between said first and second ends, wherein said first end of said insert is connected to said second end of said conduit, said second end of said insert extends into said flow line with the opening at said second end of said insert oriented substantially away from said riser, and a portion of said at least one aperture is vertically aligned with a portion of said opening at the second end of said insert.

6. A method for removing liquids from a fuel gas riser connected to a flow line to prevent said liquids from extending beyond a predetermined vertical level in said riser comprising:

a. connecting a conduit having a first end and a second end, wherein said first end of said conduit is attached to said riser at said predetermined vertical level, and said second end of said conduit is attached to said flow line downstream of said riser;

b. extending a substantially tubular insert member partially into said flow line, said insert member having an upper end, a lower end, openings at said upper and lower ends, and at least one aperture between said upper and lower ends, wherein said upper end of said insert member is connected to said conduit, said lower end of said insert member extends into said flow line with the opening at said lower end of said insert oriented substantially away from said riser, and a portion of said at least one aperture is vertically aligned with a portion of said opening at the lower end of said insert member;

c. applying a suction force to said conduit; and d. transferring liquids from said riser to said flow line through said tubular insert member and conduit.

* * * * *